US006820960B2

(12) United States Patent
Yun et al.

(10) Patent No.: US 6,820,960 B2
(45) Date of Patent: Nov. 23, 2004

(54) MAINTENANCE APPARATUS OF AN INKJET PRINTER AND WIPER-POSITIONING METHOD THEREFOR

(75) Inventors: Seuk-jin Yun, Anyang (KR); Gui-taek Lim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 9 days.

(21) Appl. No.: 10/456,597

(22) Filed: Jun. 9, 2003

(65) Prior Publication Data

US 2004/0061736 A1 Apr. 1, 2004

(30) Foreign Application Priority Data

Sep. 30, 2002 (KR) ..... 10-2002-0059371

(51) Int. Cl.[7] ..... B41J 2/165
(52) U.S. Cl. ..... 347/33; 347/29; 347/32
(58) Field of Search ..... 347/22, 29, 32, 347/33

(56) References Cited

FOREIGN PATENT DOCUMENTS

JP 06-143597 * 5/1994

OTHER PUBLICATIONS

Pg Pub. 2003/0090515, "Maintenance Apparatus of an Inkjet Printer and Method Thereof", Jin–ho Park, Nov. 13, 2002, (Pos. No. Pending).*

* cited by examiner

*Primary Examiner*—Shih-Wen Hsieh
(74) *Attorney, Agent, or Firm*—Staas & Halsey LLP

(57) ABSTRACT

A maintenance apparatus of an inkjet printer includes a control unit to control a drive motor for a wiping member convey unit to be in contact with a stopper two or more times in order to prevent a wiping member and a wiper disposed therein from being erroneously positioned due to an abnormal repulsive force occurring in the wiping member convey unit when the wiping member convey unit comes in contact with the stopper, due to outer impact and changes in load of the motor. The wiper-positioning method includes a first contact operation of driving the motor for the wiping member convey device to come in contact with the stopper, and a re-contact operation of controlling the motor for the wiping member convey unit to be in contact with the stopper one or more times again.

25 Claims, 5 Drawing Sheets

MAINTENANCE APPARATUS OF AN INKJET PRINTER AND WIPER-POSITIONING METHOD THEREFOR

CROSS-REFERENCE TO RELATED APPLICATIONS

This application claims the benefit of Korean Application No. 2002-59371, filed Sep. 30, 2002, in the Korean Intellectual Property Office, the disclosure of which is incorporated herein by reference.

BACKGROUND OF THE INVENTION

1. Field of the Invention

The present invention relates to a maintenance apparatus of an inkjet printer, and more particularly, to a maintenance apparatus of an inkjet printer and a wiper-positioning method to precisely control a wiper stop position to prevent damage to the printer due to friction contact between a carrier conveying a print head or an ink spray nozzle of a print head, and a wiper wiping the print head.

2. Description of the Related Art

Generally, an inkjet printer includes a paper feed apparatus to supply one sheet of paper at a time, a paper convey apparatus to convey the supplied sheet of paper to be printed on one line at a time, a print apparatus to print an image by spraying ink onto the sheet of paper, a paper discharge apparatus to discharge the printed sheet to an outside, and a maintenance apparatus to clean the surface of a print head nozzle of the print apparatus, collect and store waste ink, and seal the surface of the print head nozzle at the same time.

The maintenance apparatus maintains the surface of the ink spray nozzle of the print head in good condition and is thus essential to the inkjet printer of the print head to perform a satisfactory printing function.

In FIGS. 1 and 2A–2C, a general maintenance apparatus 1 used in an inkjet printer is illustrated. The maintenance apparatus 1 shown in FIGS. 1 and 2 includes a housing 5 connected with a main frame (not shown) of the inkjet printer, and a capping member 10 disposed inside the housing 5 and including two caps 16 (only one is shown) to seal the surfaces of ink spray nozzles 3 of mono and color print heads 2 (only one is shown) mounted in a carrier 6. The maintenance apparatus 1 includes a wiping member 20 disposed inside the housing 5 and including two wipers 24 (only one is shown) to wipe the surfaces of the ink spray nozzles 3 of the print heads 2, a power transmission device 30 to receive a rotation force from a bi-directional motor provided separately from a print head motor (not shown) to drive the carrier 6 with the print heads 2 disposed therein, and a capping member convey device 14, 40 to convert a rotation force of the power transmission device 30 into a vertical force and to transmit the converted force to a capping member 10. The maintenance apparatus 1 further includes a wiping member convey device 26, 28, 50 to convert a rotation force of the power transmission device 30 into a horizontal force and transmit the converted force to the wiping member 20.

The capping member 10 includes a rotation convey body 12 with the caps 16 formed on the upper surface thereof, and the wiping member 20 includes a horizontal convey body 22 with one of the wipers 24 disposed at one side.

The power transmission device 30 includes a first pulley 35 coaxially formed on a motor 32 to transmit a rotation force from the motor 32, a second pulley 37 engaged with the first pulley 35 by a belt 36, and a first gear (not shown) coaxially formed with the second pulley 37.

The capping member convey device 14, 40 includes a first connection pin 14 to hinge one end of the rotation convey body 12 to pivotably support the rotation convey body 12 in the direction illustrated by arrow A, and a first crank device 40.

The first crank device 40 includes a crank gear 39 connected with the first gear of the power transmission device 30, a crank shaft 41 coaxially connected with the crank gear 39, two first crank arms 42, 42' each with one end connected on the crank shaft 41, and two first connecting rods 44, 44' each with one end respectively connected with the other ends of the first crank arms 42, 42' by a second connection pin 43, and other ends connected with the lower part of the other ends of the rotation convey body 12 by a third connection pin 45.

The wiping member convey device 26, 28, 50 includes two elongated guide grooves 28 formed in a length direction inside both sides of the upper portion of the housing 5, two elongated slide protrusions 26 formed on both sides of the horizontal convey body 22 to correspond with the guide grooves 28 to slide along the guide grooves 28 in a horizontal direction, i.e., the direction illustrated by arrow B, which is perpendicular to the moving direction of the print heads 2, and a second crank device 50 connected with the first gear of the power transmission device 30.

The second crank device 50 includes a crank gear 39 connected with the first gear of the power transmission device 30, a crank shaft 41 coaxially connected with the crank gear 39, two second crank arms 52, 52' each with one end respectively connected on the crank shaft 41, and two second connecting rods 54, 54' each with one end respectively connected with the other ends of the second crank arms 52, 52' by fourth connection pins 53, 53' and the other ends connected with one end of the horizontal convey body 22 by fifth connection pins 55, 55'.

The operation of the maintenance apparatus 1 for an inkjet printer structured as above will be described below with reference to FIGS. 1 and 2.

When the print heads 2 mounted in the carrier 6 complete printing by spraying ink on a sheet of paper while being moved left and right by a print head drive motor within a printing area, the print heads 2 move into a maintenance area, as shown in FIG. 2A.

After the print heads 2 reach the maintenance area, the bi-directional motor 32 rotates in a first direction, for example, counter clockwise, the rotation force of the motor 32 is transferred from the first pulley 35 to the second pulley 37 by the belt 36, and then finally to the crank gear 39 through the first gear coaxially formed with the second pulley 37 rotating the crank gear clockwise.

As shown in FIG. 2B, as the crank gear 39 rotates clockwise, the crack shaft 41 coaxially connected with the crank gear 39 also rotates clockwise, and accordingly the rotation convey body 12 of the capping member 10 placed in a standby position rotates counter clockwise around the first connection pin 14 by the first crank device 40 of the capping member convey device 14.

The horizontal convey body 22 of the wiping member 20 moves to the right in the horizontal direction as the slide protrusion 26 slides along the guide groove 28 by the second crank device 50 of the wiping member convey device.

As the horizontal convey body 22 moves to the right, the wipers 24 formed to protrude upward at one side of the horizontal convey body 22 also move to the right, and accordingly the wiper 24 performs a wiping operation cleaning remaining ink, fine dust, etc. on the surface of the ink spray nozzles 3 of the print heads 2.

After the wiping operation is completed, the wipers 24 are cleaned by a wiper cleaner (not shown) horizontally disposed in the housing 5, and the waste ink which was on the upper end of the wipers 24 is collected in an ink storing receptacle (not shown) disposed in the housing 5 below the wiper cleaner.

When the rotation convey body 12 continues to rotate counter clockwise by the crank gear 39, the caps 16 disposed on the upper surface of the rotation convey body 12 of the capping member 10 have one side close to the first connection pin 14, brought in contact with the surface of the ink spray nozzles 3 of the print heads 2 forming a predetermined initial contact angle and then gradually sealing the surfaces of the ink spray nozzles 3 of the print heads 2.

After the caps 16 close the surfaces of the ink spray nozzles 3 of the print heads 2, the slide protrusion 26 of the horizontal convey body 22 is blocked by a stopper 29 thereby cutting the power of the motor 32, and accordingly the first and second crank devices 40, 50 connected to the horizontal convey body 22 are consecutively stopped.

Consequently, the rotation convey body 12 of the capping member 10 is maintained to have the caps 16 in a capping position covering the surface of the ink spray nozzles 3 of the print heads 2 and the horizontal convey body 22 of the wiping member 20 in a standby position, as shown in FIG. 2C.

When a print command is received at this point, the rotation convey body 12 of the capping member 10 and the horizontal convey body 22 of the wiping member 20 perform uncapping and wiping processes in the reverse order to the above described operation by the first and second crank devices 40, 50 from the position shown in FIG. 2C.

After the rotation convey body 12 and the horizontal convey body 22 perform the uncapping and wiping processes, when the second crank arms 52, 52' of the second crank device 50 continuously rotate counter clockwise, thereby coming in contact with a stopper 60, the bi-directional motor 32 rotates in the opposite direction, i.e., counter clockwise, for a predetermined duration in order to position the horizontal convey body 22, and then stops. Accordingly, the crank gear 39 of the second crank device 50 rotates clockwise by a predetermined angle until a waste ink receiving portion 25 of the horizontal convey body 22 moves to the right to be placed at a spitting position (FIG. 2A) below the ink spray nozzles 3 of the print heads 2, and then stops.

In this state, a spitting operation is performed to discharge the other color ink, air bubbles, and fine dust attached on the surface of the ink spray nozzles 3 during the wiping operation of the wiper 24.

The waste ink collected from the ink spray nozzles 3 is absorbed and stored in an absorbing body mounted in a waste ink receiving groove in the waste ink receiving portion 25. After that, the print heads 2 are moved into the printing area by the print head drive motor and perform a printing operation while moving left and right.

However, in the conventional maintenance apparatus 1 operating in such a way, the second crank arms 52, 52' of the second crank device 50 are controlled to change the rotation direction by the bi-directional motor 32 after coming in contact with the stopper 60 when the horizontal convey body 22 of the wiping member 20 is moved to the spitting position.

Therefore, when the second crank arms 52, 52' come in contact with the stopper 60, if the second crank arms 52, 52' spring out due to the repulsive force against the stopper 60, the horizontal convey body 22 is pushed to the right as much as the second crank arms 52, 52' spring out. Accordingly, when the second crank arms 52, 52' change the rotation direction and rotate by a predetermined angle, the horizontal convey body 22 moves further as much as the second crank arms 52, 52' spring out and stop, thereby causing a positioning error.

If the horizontal convey body 22 is erroneously positioned, the stopping position of the wiper 24 disposed on the upper surface of one side of the horizontal convey body 22 becomes inaccurate, and therefore when the carrier 6 having the ink spray nozzles 3, or the print heads 2 disposed therein, move into the printing area or return back to the maintenance area, the wipers 24 and the ink spray nozzles 3 of the print heads 2 or the carrier 6 may have friction contact, and thereby be damaged.

SUMMARY OF THE INVENTION

Accordingly, it is an aspect of the present invention to solve at least the above problems and/or disadvantages of the related art and to provide at least the advantages described hereinafter.

It is another aspect of the present invention to solve the foregoing and/or other problems by providing a maintenance apparatus of an inkjet printer and a wiper-positioning method of precisely controlling a wiper stop position to prevent damage due to friction contact between a carrier conveying a print head or an ink spray nozzle of the print head and a wiper wiping the print head.

Additional aspects and/or advantages of the invention will be set forth in part in the description which follows and, in part, will be obvious from the description, or may be learned by practice of the invention.

The foregoing and/or other aspects and advantages are realized by providing a maintenance apparatus of an inkjet printer including a housing disposed in a maintenance area; a print head having an ink spray nozzle; a wiping member disposed in the housing and including a wiper to wipe a surface of the ink spray nozzle when the print head is in the maintenance area; a drive motor to generate a rotational force; a power transmission device to transmit the rotational force; a wiping member convey unit to receive the transmitted rotational force and to the received rotational force into a horizontal force and to transmit the converted force to convert the wiping member; a stopper to stop the wiping member convey unit to place the wiping member at a predetermined position; and a control unit to control the drive motor so that the wiping member convey unit is in contact with the stopper two times to prevent the wiping member and the wiper from being erroneously positioned due to an abnormal repulsive force occurring in the wiping member convey unit when the wiping member convey unit comes in contact with the stopper, the repulsive force being caused by an outer impact or a change in a load of the drive motor.

The control unit may include a load sensor to detect a load of the motor in order to detect when the wiping member convey device comes in contact with the stopper.

The wiping member convey device may include a guide groove formed in a length direction on an inner surface of the housing; first and second elongated slide protrusions formed on first and second sides of the wiping member to correspond with the guide groove to slidably move along the guide groove in a direction which is perpendicular to a moving direction of the print head; and a crank device connected to the power transmission device.

The stopper may include a rib disposed in the housing on a convey path of the crank arm to stop the crank arm.

According to another embodiment of the present invention, a wiper-positioning method of a maintenance apparatus in an inkjet printer includes a crank gear connected to the power transmission device; a crank shaft coaxially connected with the crank gear; a crank arm having a first end connected with the crank shaft; first and second connection pins; a connecting rod with a first end connected with a second end of the crank arm by the first connection pin and a second end connected with the wiping member by the second connection pin.

The wiper-positioning method may further include driving the wiping member convey device to move in a direction opposite to a direction in which the wiping member convey device moves to be in contact with the stopper in order to place the wiping member convey device at a stop position after the wiping member convey device is again in contact with the stopper.

In the re-contacting, the motor is driven with less speed and drive force than when the wiping member convey device is brought in contact with the stopper during the first contacting.

Additionally, timing to perform the re-contacting and the positioning are controlled by a signal from a load sensor to detect a load of the motor occurring when the wiping member convey device is in contact with the stopper.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
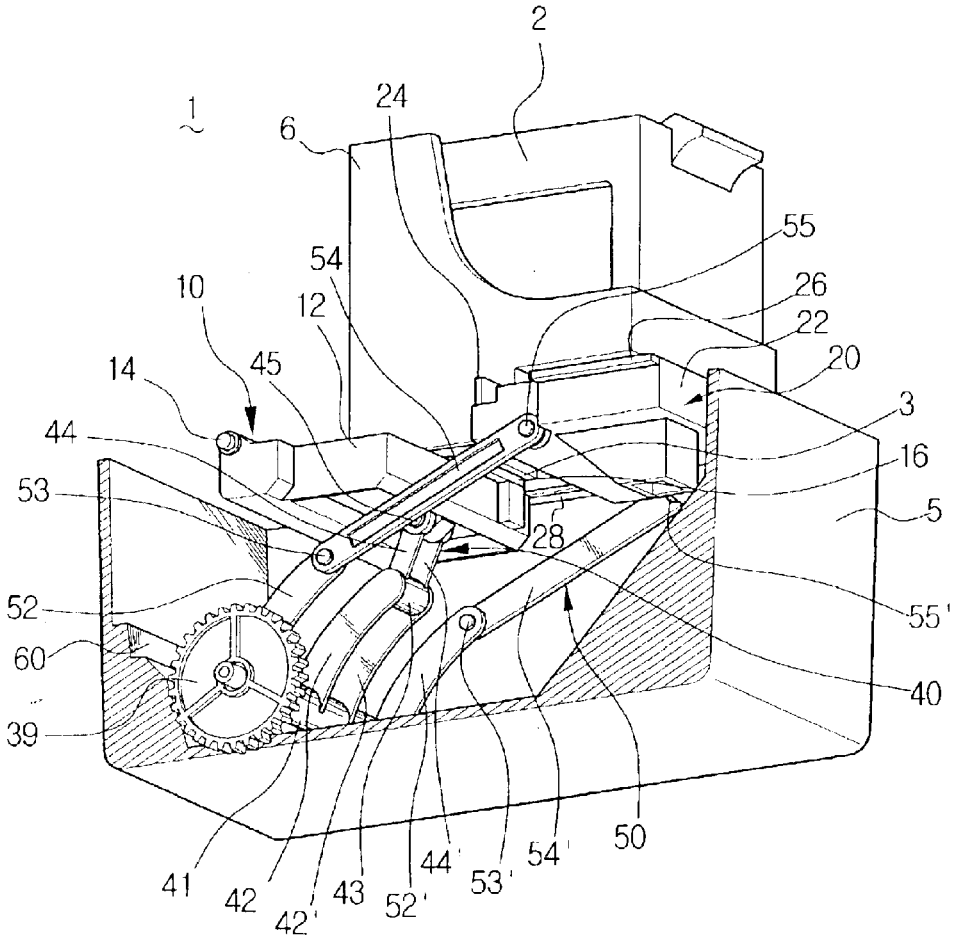
FIG. 1 (PRIOR ART)
FIG. 1 is a partially cut perspective view showing a conventional maintenance apparatus of an inkjet printer.

Reference will now be made in detail to the present preferred embodiments of the present invention, examples of which are illustrated in the accompanying drawings, wherein like reference numerals refer to like elements throughout.

The maintenance apparatus of an inkjet printer according to an embodiment of the present invention includes features similar to the conventional maintenance apparatus 1, and therefore the illustration of these features is not repeated. Specifically, the embodiment of the present invention includes a housing connected with a main frame in an inkjet printer maintenance area, a capping member disposed in the housing and including two caps to seal the surfaces of ink spray nozzles of mono and color print heads disposed in a carrier moving between a printing position and a maintenance position. The apparatus of the present embodiment further includes a wiping member disposed in the housing and including two wipers to wipe the surfaces of the ink spray nozzles of the print head in a direction which is perpendicular to the carrier moving direction. The apparatus further includes a power transmission device 300 (see FIG. 3) to transmit a rotation force from a bi-directional motor 320 (FIG. 3) provided separately from the print head drive motor to drive the carrier with the print heads disposed therein, a capping member convey device to convert a rotation force of the power transmission device 300 into a vertical force and transmit the converted force to the capping member 10, a wiping member convey device to convert a rotation force of the power transmission device 300 into a horizontal force and transmit the converted force to the wiping member, and a control unit 100 (FIG. 3) to control the motor 320 so that second crank arms are in contact with a stopper two or more times in order to prevent a positioning error of the wiping member and the wipers. This positioning error may be due to an abnormal repulsive force created in the second crank arms by external impact, or a load change in the motor when the second crank arms of the second crank device of the wiping member convey device come in contact with the stopper.

The stopper is formed of a rib disposed in the housing on a convey path of the second crank arm to stop the second crank arm.

Figure 3:
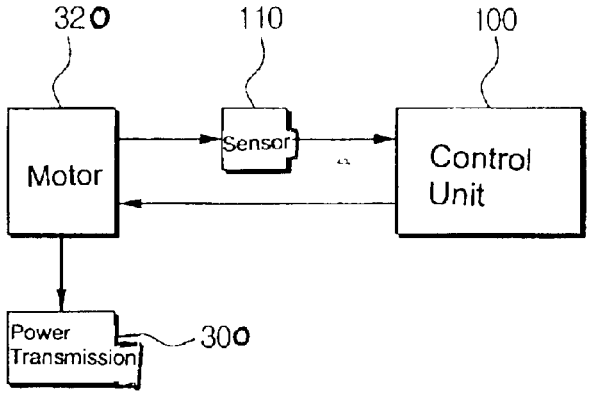
FIG. 3 is a block diagram showing a control flow of a maintenance apparatus for an inkjet printer according to an embodiment of the present invention.

As shown in FIG. 3, in order to detect when the second crank arms come in contact with the stopper, the control unit 100 includes a load sensor 110. The load sensor 110 may be similar to a one channel sensor disposed in the bi-directional motor 320 using a DC motor to detect the load of rotation in each direction of the bi-directional motor 320.

Furthermore, the control unit 100 positions the wiping member at a stopping position by driving the motor 320 for the second crank arm to be moved in a direction opposite to a direction in which the second crank arms move to be in contact with the stopper after the second crank arms come in contact with the stopper again.

Therefore, although the second crank arms have an abnormal repulsive force against the stopper due to vibration or load change of the motor 320 when the second crank arms come in contact with the stopper after the uncapping and wiping operations, the wiping member can be placed at an accurate position. This is achieved regardless of the repulsive force of the second crank arms since the wiping member is placed at a predetermined stop position after being moved again in the direction opposite to the direction in which the second crank arms generate the repulsive force, i.e., the direction in which the second crank arms come in contact with the stopper by the control unit 100. Accordingly, the friction between the wipers mounted in the wiping member and the carrier or the ink spray nozzles of the print heads caused by a positioning error can be prevented.

Alternatively, in order to assist positioning of the wiping member, a resilient spring (not shown) can be additionally disposed between the horizontal convey body of the wiping member and the inner wall of the housing. In this case, a resilient force and an installation position of the resilient spring are set to allow the wiping member to be placed at the predetermined stop position, as described above.

Figure 4:
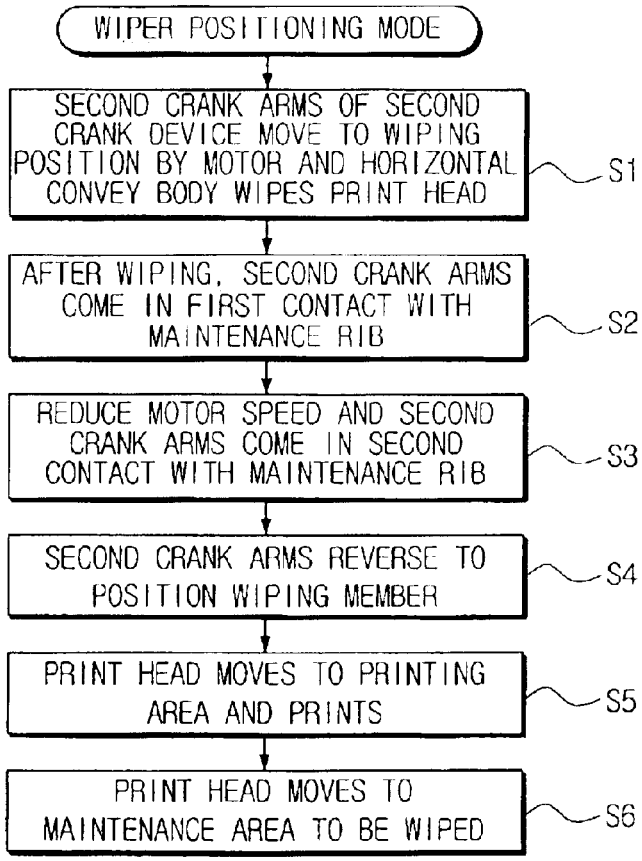
FIG. 4 is a flow chart showing a wiper positioning method of a maintenance apparatus for an inkjet printer according to the embodiment of the present invention.

Hereinafter, the wiper positioning method of the maintenance apparatus of the inkjet printer according to the embodiment of the present invention will be described with reference to FIGS. 3 and 4.

Figure 2A:
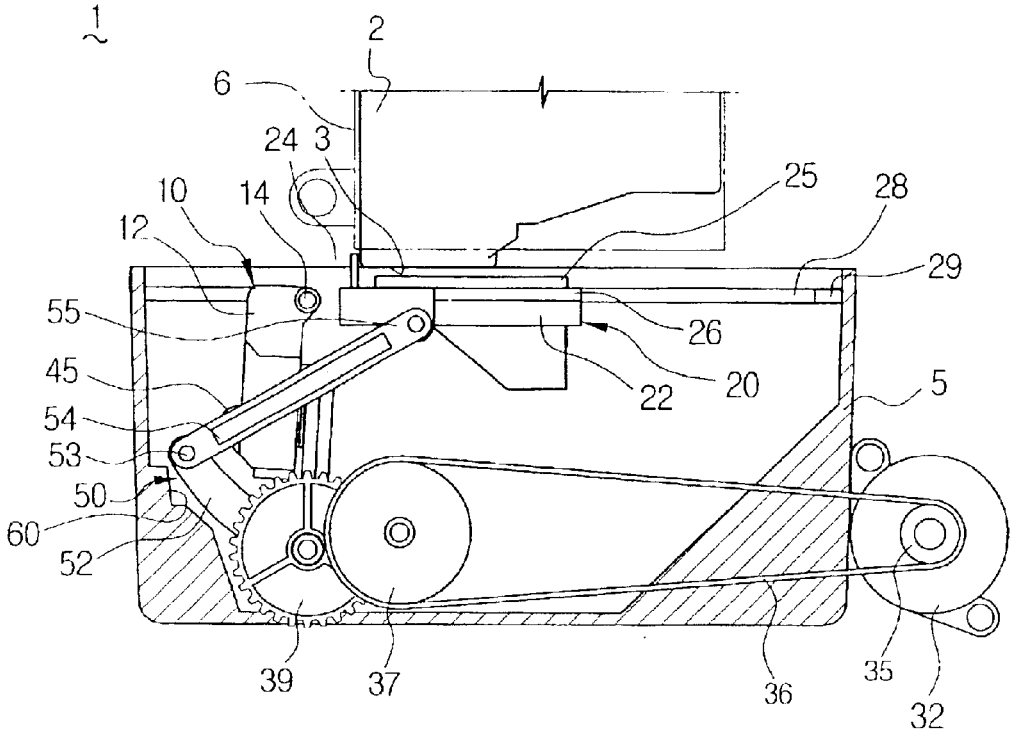
FIG.2A (PRIOR ART)
FIGS. 2A, 2B and 2C are sectional views illustrating the operation of the maintenance apparatus of FIG. 1.
Figure 2B:
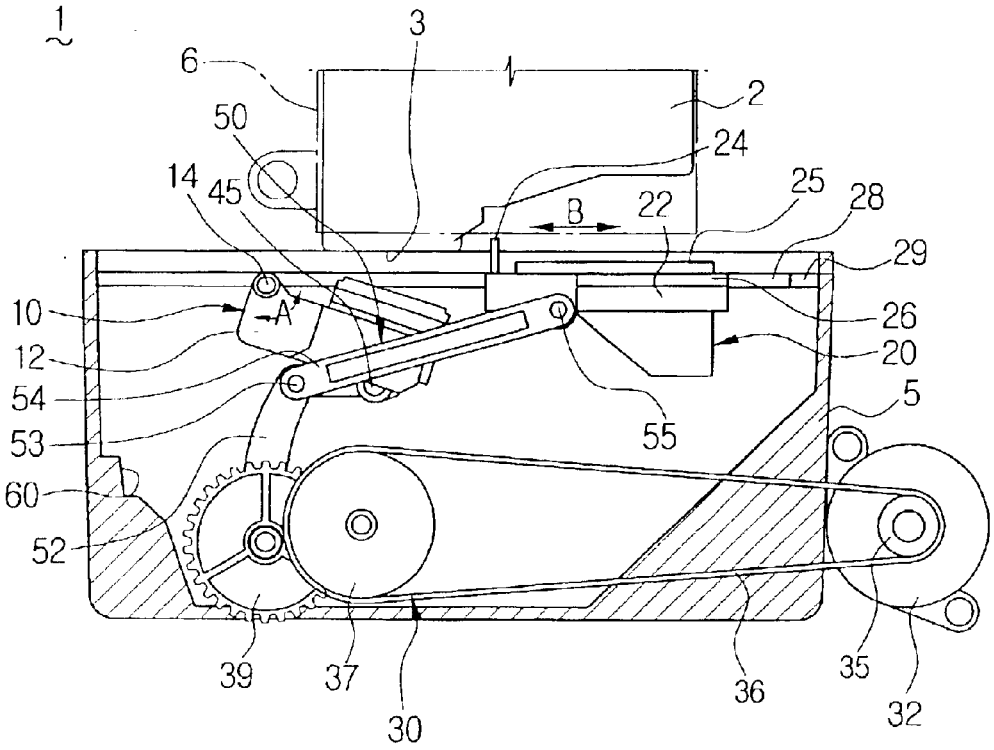
FIG.2B (PRIOR ART)
Figure 2C:
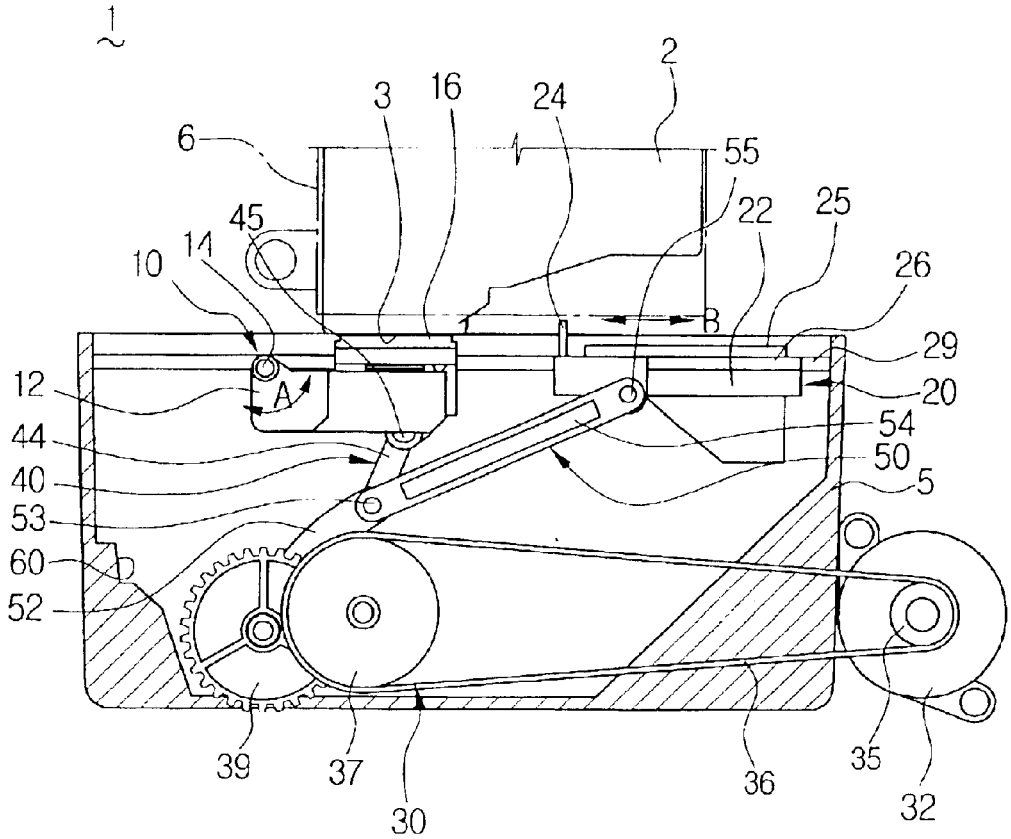
FIG.2C (PRIOR ART)

Similar to the conventional maintenance apparatus 1 shown in FIG. 2C, it is assumed that the printer head of the present embodiment is placed at a capping position to be sealed by the rotation convey body of the capping member, and the horizontal convey body of the wiping member is placed at a standby position.

When a print command is received, the rotation convey body and the horizontal convey body uncap and wipe the print heads by the counter clockwise rotation of the first and second crank arms of the first and second crank devices with respect to the clockwise rotation of the bi-directional motor 320, as in the maintenance apparatus described with reference to the FIGS. 1 and 2 (S1).

After the rotation convey body and the horizontal convey body perform uncapping and wiping operations, the crank gear of the second crank device continuously rotates counter clockwise. Thereby, the second crank arms come in first contact with the stopper, the second crank arms get a repulsive force against the stopper by a rotational drive force due to a predetermined speed transmitted from the bi-directional motor 320, outer impacts and the like. The horizontal convey body moves to the right as much as the rotation angle in which the second crank arms are protruded by the repulsive force (S2).

At this time, the load sensor 110 of the control unit 100 disposed in the motor 320 receives a counter clockwise load and sends a load signal to the control unit, and in accordance with the signal, the control unit 100 drives the motor 320 with reduced rotational speed and driving force, so that the second crank arms come in contact with the stopper again. As a result, the second crank arms come in contact with the stopper for a second time and create a repulsive force against the stopper, thereby being protruded. However, since the rotation speed and the drive force of the bi-directional motor 320 are reduced, the horizontal convey body moves only slightly to the right due to the second crank arms (S3).

The control unit rotates the bi-directional motor 320 counter clockwise in order to position the wiping member, and accordingly the second crank arms of the second crank device rotate clockwise by a predetermined angle until the waste ink receiving portion of the horizontal convey body moves to the right, thereby being placed at a spitting position below the ink spray nozzles of the print heads, and stops (S4).

In that state, a spitting operation is performed to discharge different color ink, air bubbles and fine dust stuck to the surface of the ink spray nozzles during the wiping operation of the wiper.

After the spitting operation is completed, the carrier moves from the maintenance area to the printing area for printing. The print head moved into the printing area performs printing while moving left and right by the print head drive motor according to the control of the control unit 100 (S5).

After the printing is completed, the print head moves again into the maintenance area and is kept in the capping position after the wiping operation is performed in the same manner as the conventional maintenance apparatus shown in FIGS. 1 and 2 (S6).

As described above, the maintenance apparatus of an inkjet printer and the wiper-positioning method can precisely control the stop position of the wiper to wipe the print heads. Thereby, damage is prevented to the parts due to friction contact between a carrier conveying the print heads or the ink spray nozzles of the print heads and wipers to wipe the print heads.

Although a preferred embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A maintenance apparatus of an inkjet printer comprising:

a housing disposed in a maintenance area;

a print head having an ink spray nozzle;

a wiper to wipe a surface of the ink spray nozzle when the print head is in the maintenance area;

a wiping member disposed in the housing, the wiper being disposed therein;

a drive motor to generate a rotational force;

a power transmission device to transmit the rotational force;

a wiping member convey unit to receive the transmitted rotational force and to convert the received rotational force into a horizontal force and to transmit the horizontal force to the wiping member;

a stopper to stop the wiping member convey unit to place the wiping member at a predetermined position; and a control unit to control the drive motor so that the wiping member convey unit is in contact with the stopper first and second times to prevent the wiping member and the wiper from being erroneously positioned due to an abnormal repulsive force occurring in the wiping member convey unit when the wiping member convey unit comes in contact with the stopper, the repulsive force being caused by an outer impact or a change in a load of the drive motor.

2. The maintenance apparatus of an inkjet printer according to claim 1, wherein the control unit comprises a load sensor to detect the load of the drive motor in order to detect when the wiping member convey unit comes in contact with the stopper.

3. The maintenance apparatus of an inkjet printer according to claim 2, wherein the wiping member convey unit comprises:

a guide groove formed in a length direction on an inner surface of the housing;

first and second elongated slide protrusions formed on first and second sides of the wiping member to correspond with the guide groove to slidably move along the guide groove in a direction which is perpendicular to a moving direction of the print head; and a crank device connected to the power transmission device.

4. The maintenance apparatus of an inkjet printer according to claim 3, wherein the crank device comprises:

a crank gear connected to the power transmission device;

a crank shaft coaxially connected with the crank gear;

a crank arm having a first end connected with the crank shaft;

first and second connection pins; and a connecting rod with a first end connected with a second end of the crank arm by the first connection pin and a second end connected with the wiping member by the second connection pin.

5. The maintenance apparatus of an inkjet printer according to claim 4, wherein the stopper comprises a rib disposed in the housing on a convey path of the crank arm to stop the crank arm.

6. The maintenance apparatus of an inkjet printer according to claim 1, further comprising a resilient body disposed between the wiping member and the housing.

7. A wiper-positioning method of a maintenance apparatus in an inkjet printer comprising:

driving a motor so that a wiping member convey unit moves in a first direction to come in contact with a stopper for a first time; and controlling the motor so that the wiping member convey unit comes in contact with the stopper for a second time, in order to prevent a wiping member and a wiper disposed in the wiping member from being erroneously positioned due to an abnormal repulsive force occurring in the wiping member convey unit when the wiping member convey unit comes in contact with the stopper due to an outer impact of, or changes in a load of the motor.

8. The wiper-positioning method of a maintenance apparatus in an inkjet printer according to claim 7, further comprising driving the motor so that the wiping member convey unit moves in a second direction opposite to the first direction to place the wiping member convey unit at a stop position after the wiping member convey unit contacts the stopper for the second time.

9. The wiper-positioning method of a maintenance apparatus in an inkjet printer according to claim 8, wherein driving the motor so that the wiping member convey unit moves in the second direction comprises controlling the driving according to a signal from a load sensor to detect the load of the motor occurring when the wiping member convey unit is in contact with the stopper.

10. The wiper-positioning method of a maintenance apparatus in an inkjet printer according to claim 7, wherein the motor is driven with a lower speed and a lower drive force when the wiping member convey unit contacts the stopper for the second time as compared to when the wiping member convey device contacts with the stopper for the first time.

11. An apparatus comprising:

a print head;

a wiper;

a stop unit;

a moving unit to move the wiper between a first position in contact with the stop unit and a second position; and a controller to detect a load and to position the moving unit in the first position in response to the detected load.

12. The apparatus according to claim 11, wherein the wiper wipes ink and dust from a surface of the print head when the wiper is in the second position.

13. The apparatus according to claim 11, wherein the load is caused by an external impact.

14. The apparatus according to claim 11, further comprising a motor to drive the moving unit to move the wiper, wherein the load is a load of the motor.

15. The apparatus of claim 14, wherein the controller comprises a one channel sensor to detect the load.

16. The apparatus of claim 15, wherein the motor is a bi-directional motor.

17. The apparatus of claim 14, further comprising a transfer unit to transfer a force of the motor to the moving unit.

18. The apparatus of claim 17, wherein the transfer unit comprises:

a first pulley formed on the motor;

a second pulley; and a belt to engage the first and second pulleys.

19. The apparatus of claim 18, wherein the moving unit comprises:

a crank gear connected to the second pulley;

a crank shaft coaxially connected with the crank gear;

a crank arm having a first end connected with the crank shaft;

first and second connection pins; and a connecting rod with a first end connected with a second end of the crank arm by the first connection pin and a second end connected with the wiper by the second connection pin.

20. The apparatus of claim 19, wherein the print head comprises a nozzle to emit ink, and the apparatus further comprises:

a capping unit to cap the nozzle when the print head is in the second position.

21. The apparatus of claim 20, wherein the motor is driven in a first direction to move the wiper from the first position to the second position, wherein the wiper wipes ink or dust from a surface of the nozzle when the wiper is at the second position.

22. The apparatus of claim 21, wherein the motor is driven in a second direction, opposite to the first direction, to move the wiper from the second position to the first position, wherein a spitting operation is performed on the print head when the wiper is at the first position to remove the wiped ink and dust.

23. The apparatus of claim 22, wherein the second position is a standby position, the spitting operation is performed in response to a printing signal, and the print head performs a printing operation after the spitting operation.

24. The apparatus of claim 23, wherein a speed of the wiper when being positioned in the first position in response to the detected load is slower than a speed of the wiper when being moved from the second position to the first position in response to the printing signal.

25. An apparatus comprising:

a print head to move between printing and maintenance areas;

a wiper to wipe the print head when the print head is in the maintenance area; and a controller to maintain a position of the wiper by detecting a load when the print head is in the printing area.

* * * * *